US010132207B2

(12) United States Patent
Takehana et al.

(10) Patent No.: US 10,132,207 B2
(45) Date of Patent: Nov. 20, 2018

(54) VARIABLE VALVE MECHANISM FOR INTERNAL COMBUSTION ENGINE

(71) Applicants: HONDA MOTOR CO., LTD., Tokyo (JP); TANAKA SEIMITSU KOGYO CO., LTD., Toyama-shi, Toyama (JP)

(72) Inventors: Kaori Takehana, Wako (JP); Masaru Izawa, Toyama (JP)

(73) Assignees: HONDA MOTOR CO., LTD., Tokyo (JP); TANAKA SEIMITSU KOGYO CO., LTD., Toyama-shi (JP)

( * ) Notice: Subject to any disclaimer, the term of this patent is extended or adjusted under 35 U.S.C. 154(b) by 43 days.

(21) Appl. No.: 15/623,579

(22) Filed: Jun. 15, 2017

(65) Prior Publication Data

US 2017/0362966 A1 Dec. 21, 2017

(30) Foreign Application Priority Data

Jun. 17, 2016 (JP) ..... 2016-120823

(51) Int. Cl.

| | |
|---|---|
| ***F01L 1/18*** | (2006.01) |
| ***F01L 1/24*** | (2006.01) |
| ***F01L 1/14*** | (2006.01) |
| ***F01L 13/00*** | (2006.01) |
| *F01L 3/10* | (2006.01) |
| *F01L 3/00* | (2006.01) |

(52) U.S. Cl.

CPC ..... *F01L 1/2411* (2013.01); *F01L 1/14* (2013.01); *F01L 1/143* (2013.01); *F01L 1/181* (2013.01); *F01L 1/185* (2013.01); *F01L 1/2405* (2013.01); *F01L 13/0005* (2013.01); *F01L 3/10* (2013.01); *F01L 2003/11* (2013.01); *F01L 2105/00* (2013.01)

(58) Field of Classification Search

CPC . F01L 1/14; F01L 1/181; F01L 1/2411; F01L 1/2405; F01L 2003/11

USPC ..... 123/90.39, 90.44

See application file for complete search history.

(56) References Cited

U.S. PATENT DOCUMENTS

| | | | | |
|---|---|---|---|---|
| 7,424,876 | B2 * | 9/2008 | Diggs | F01L 1/14 123/90.39 |
| 8,051,814 | B2 | 11/2011 | Hirayama et al. | |
| 2008/0202457 | A1 | 8/2008 | Hirayama et al. | |

FOREIGN PATENT DOCUMENTS

| | | | |
|---|---|---|---|
| JP | 2000204917 | A | 7/2000 |
| JP | 2002-242625 | A | 8/2002 |

(Continued)

OTHER PUBLICATIONS

Office Action dated Feb. 27, 2018, issued in counterpart Japanese Application No. 2016-120823, with partial English translation. (6 pages).

*Primary Examiner* — Ching Chang

(74) *Attorney, Agent, or Firm* — Westerman, Hattori, Daniels & Adrian, LLP

(57) ABSTRACT

The variable valve actuating device (20) comprises a valve lifter (24) interposed between a swing end of a rocker arm 22 and a stem end of an engine valve (17), and a switch pin (53) slidably received in the valve lifter (24) so as to selectively abut the end surface of the valve stem as the valve lifter is actuated by a cam (21*a*). The swing end of the rocker arm abuts an upper end of a projection (55) projecting from the upper end of the valve lifter via an engagement feature (26*b*, 55*a*) that prevents a rotational movement of the valve lifter relative to the swing end around the axial line of the valve stem.

7 Claims, 11 Drawing Sheets

(56) References Cited

FOREIGN PATENT DOCUMENTS

| | | | |
|---|---|---|---|
| JP | 2007-32475 | A | 2/2007 |
| JP | 2008-208795 | A | 9/2008 |
| JP | 2011185092 | A | 9/2011 |

* cited by examiner

VARIABLE VALVE MECHANISM FOR INTERNAL COMBUSTION ENGINE

TECHNICAL FIELD

The present invention relates to a variable valve mechanism for an internal combustion engine that can vary the lift property of engine valves.

BACKGROUND ART

Various types of mechanism have been proposed for devices for varying the valve property of the intake/exhaust valves of an internal combustion engine. For instance, JP2000-204917A and JP2011-185092A disclose valve rest mechanisms that can selectively prevent the operation of some of the valves.

According to a previous proposed valve rest mechanism, a valve lifter interposed between a drive cam and a valve is internally provided with a switch pin that can selectively move between the first position and a second position under oil pressure. At the first position, a stem end of the valve abuts an abutting surface defined on the switch pin so that the valve lifter is enabled to drive the valve into the open position when the valve lifter is actuated by the cam. At the second position, the stem end of the valve is received in a through hole formed in the switch pin so that the valve is kept in the closed position because the valve stem advances into the through hole without being pushed by the valve lifter even when the valve lifter is actuated by the cam.

In such a valve rest mechanism, the valve lifter has a circular cross section and is received in a support hole of the cylinder head having a corresponding cross section so that the valve lifter could rotate around the axial line thereof in the support hole. Therefore, to ensure supply of oil pressure into the chambers defined on either axial end of the switch pin, it is necessary to form circumferential oil grooves either on the outer circumferential surface of the valve lifter or the inner circumferential surface of the support hole that communicate with these chambers.

To overcome this problem, the valve lifter may be provided with a radially projecting pin that is engaged by a slot formed in the inner circumferential surface of the support hole. However, this requires extra component parts and machining of the cylinder head, and complicates the manufacturing process so that the manufacturing cost of the engine increases. Also, the frictional resistance to the movement of the valve lifter may be affected such an engagement feature.

SUMMARY OF THE INVENTION

In view of such problems of the prior art, a primary object of the present invention is to provide a variable valve actuating device for an internal combustion engine that can be manufactured at low cost, and can be assembled without any added complexity.

To achieve such an object, the present invention provides a V engine, comprising: a valve (17) having a valve head (31) configured to selectively close an intake port or an exhaust port of a combustion chamber and a valve stem (32) slidably supported by a cylinder head (4) along an axial line thereof; a rocker arm (22) including a pivoted part (23) pivotally supported by the cylinder head, a cam follower (28) driven by a cam (21*a*) of a camshaft (21), and a swing end; a valve lifter (24) interposed between the swing end of the rocker arm and a stem end (39) of the valve stem and slidably received in a support hole (19*a*) defined in the cylinder head along the axial line of the valve stem; and a switch member (53) received in the valve lifter so as to be selectively moveable under oil pressure between a first position where the switch member abuts an end surface (39*a*) of the valve stem as the valve lifter is actuated by the cam and a second position where the switch member does not abut the end surface of the valve stem as the valve lifter is actuated by the cam; wherein the swing end of the rocker arm is engaged by an upper end part of the valve lifter via an engagement feature (26*b*, 55*a*) that prevents a rotational movement of the valve lifter relative to the swing end around the axial line of the valve stem.

In this arrangement, the rotation of the valve lifter can be prevented without requiring any extra component part. Therefore, the manufacturing cost can be reduced, and the assembly process can be simplified.

According to a preferred embodiment of the present invention, the swing end of the rocker arm includes a pair of vertical walls (26*a*) defining a gap between the vertical walls, and the upper end part of the valve lifter is provided with a projection (55) projecting upward and defining a pair of side surfaces (55*a*) closely abutting opposing surfaces (26*b*) of the vertical walls.

Thereby, the rotation of the valve lifter can be prevented by using a highly simple structure.

In the present invention, the projection may be elongated in a direction parallel to a central line of the rocker arm. Thereby, the surface area of contact between the swing end of the rocker arm and the projection can be maximized.

According to another embodiment of the present invention, the swing end of the rocker arm includes a projection (26*c*) projecting downward and defining a pair of side surfaces, and the upper end part of the valve lifter is provided with a recess (55*c*) flanked by a pair of vertical walls (55*b*) defining a pair of side surfaces (55*c*) closely abutting the opposing side surfaces of the projection of the swing end of the rocker arm.

Thereby, the rotation of the valve lifter can be prevented by using a highly simple structure.

In the present invention, the recess may be elongated in a direction parallel to a central line of the rocker arm. Thereby, the surface area of contact between the swing end of the rocker arm and the projection can be maximized.

In a preferred embodiment of the present invention, the valve lifter includes a cylindrical outer wall (51) extending along the axial line of the valve stem and a switch pin cylinder (54) extending between diametrically opposing parts of the cylindrical outer wall, and the switch member comprises a switch pin (53) slidably received in the switch pin cylinder so as to be moveable between the first position and the second position under oil pressure applied to either axial end of the switch pin, the switch pin including an abutting surface (63) configured to abut the end surface of the valve stem at the first position and a through hole (64) for receiving the stem end of the valve stem at the second position, the projection being integrally formed with the switch pin cylinder.

According to this arrangement, the weight of the valve lifter can be minimized while maximizing the mechanical stiffness and strength of the valve lifter against the loading applied by the rocker arm.

Preferably, the two vertical walls of the swing end of the rocker arm are connected to each other via a sliding member, a lower surface of the sliding member (27) defining a surface for sliding contact with the projection of the valve lifter.

Thereby, the engagement feature can be realized in a simple manner while the mechanical stiffness and strength of the swing arm can be maximized.

DESCRIPTION OF THE PREFERRED EMBODIMENT(S)

An embodiment of the present invention is described in the following with reference to appended drawings.

Figure 1:
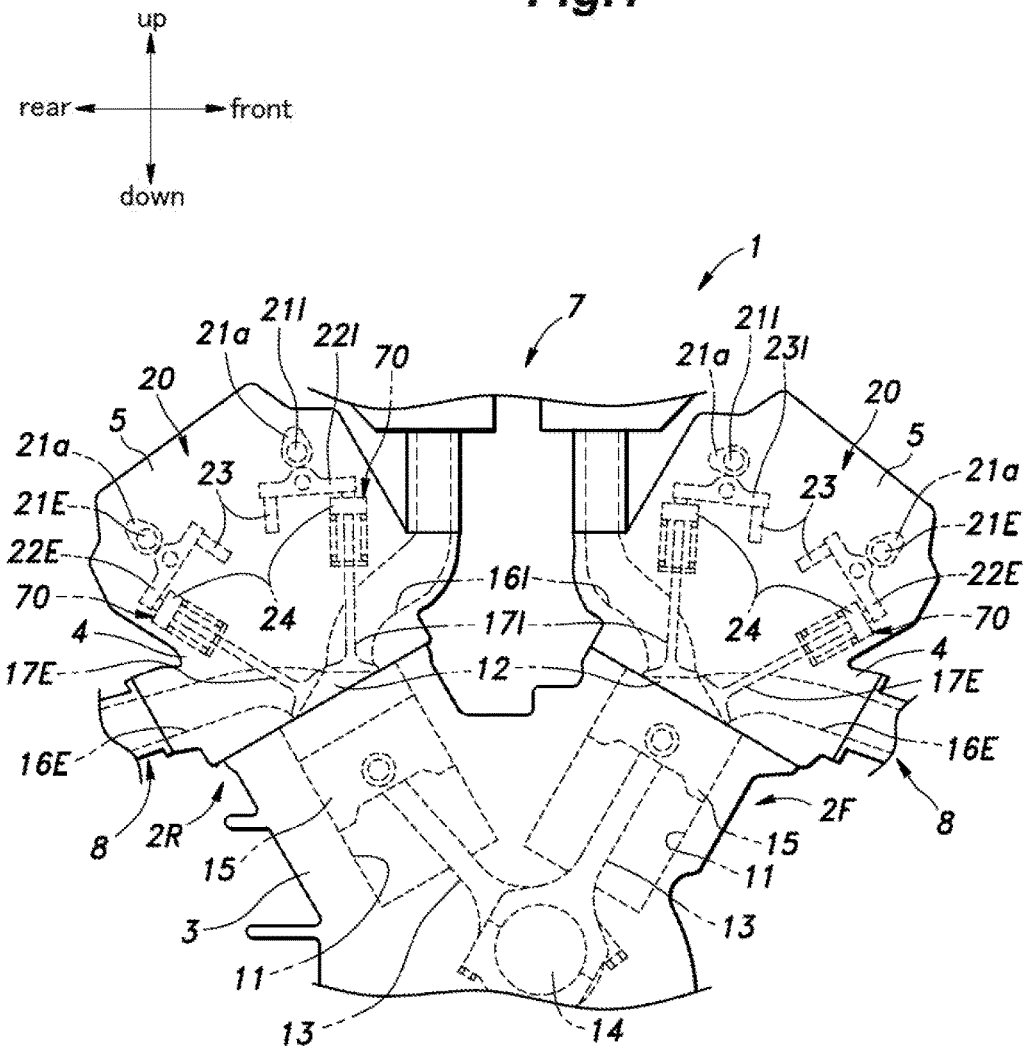
FIG. 1 is a front view of an engine fitted with a valve actuating device embodying the present invention.

FIG. 1 is a front view of an engine 1 fitted with a variable valve actuating device embodying the present invention. The engine 1 consists of a DOHC, 6-cylinder, V engine, and is mounted laterally on a vehicle with the right hand side of the engine as shown in FIG. 1 positioned on the front side of the vehicle. The directions referred to in the following description will be based on the directions with respect to the vehicle.

The engine 1 includes a cylinder block 3 having a front cylinder bank 2F and a rear cylinder bank 2R, a cylinder head 4 attached to the upper end of each cylinder bank 2 and a head cover 5 attached to the upper end of each cylinder head 4. An intake system 7 of the engine 1 is positioned between the two cylinder banks 2, and an exhaust system 8 is positioned on the outer sides of the two cylinder banks 2.

Each cylinder bank 2 defines three cylinder bores 11, and combustion chambers 12 are formed on the opposing side of the corresponding cylinder head 4 in a corresponding manner. The cylinder bores 11 and the combustion chambers 12 jointly form cylinders. Each cylinder bore 11 slidably receives a piston 15 which is connected to a crankshaft 14 of the engine 1 via a connecting rod 13.

Each combustion chamber 12 communicates with an intake port 161 which opens out on the inner side of the corresponding cylinder bank 2 and an exhaust port 16E which opens out on the outer side of the corresponding cylinder bank 2. Each combustion chamber 12 is provided with two intake ports 161 and two exhaust ports 16E. Valves 17 (intake valves 171 and exhaust valves 17E) are slidably supported by the cylinder head 4 for selectively closing the combustion chamber ends of the intake ports 161 and the exhaust ports 16E by being actuated by a valve actuating device 20.

The valve actuating device 20 includes, for each of the intake and exhaust sides of each cylinder bank 2, a camshaft 21 (intake camshaft 211, exhaust camshaft 21E) provided with a plurality of cams 21*a* arranged along the length thereof, rocker arms 22 (intake rocker arms 221, exhaust rocker arms 22E), lash adjusters 23 each pivotally supporting an end of the corresponding rocker arm 22, and valve lifters 24 each interposed between the corresponding rocker arm 22 and the associated valve 17. The camshafts 21 (intake camshaft 211 and exhaust camshaft 21E) are rotatively actuated in synchronism with the rotation of the crankshaft 14 so that the valves 17 may be actuated by the cams 21*a* as required via the rocker arms 22 and the valve lifters 24.

Figure 2:
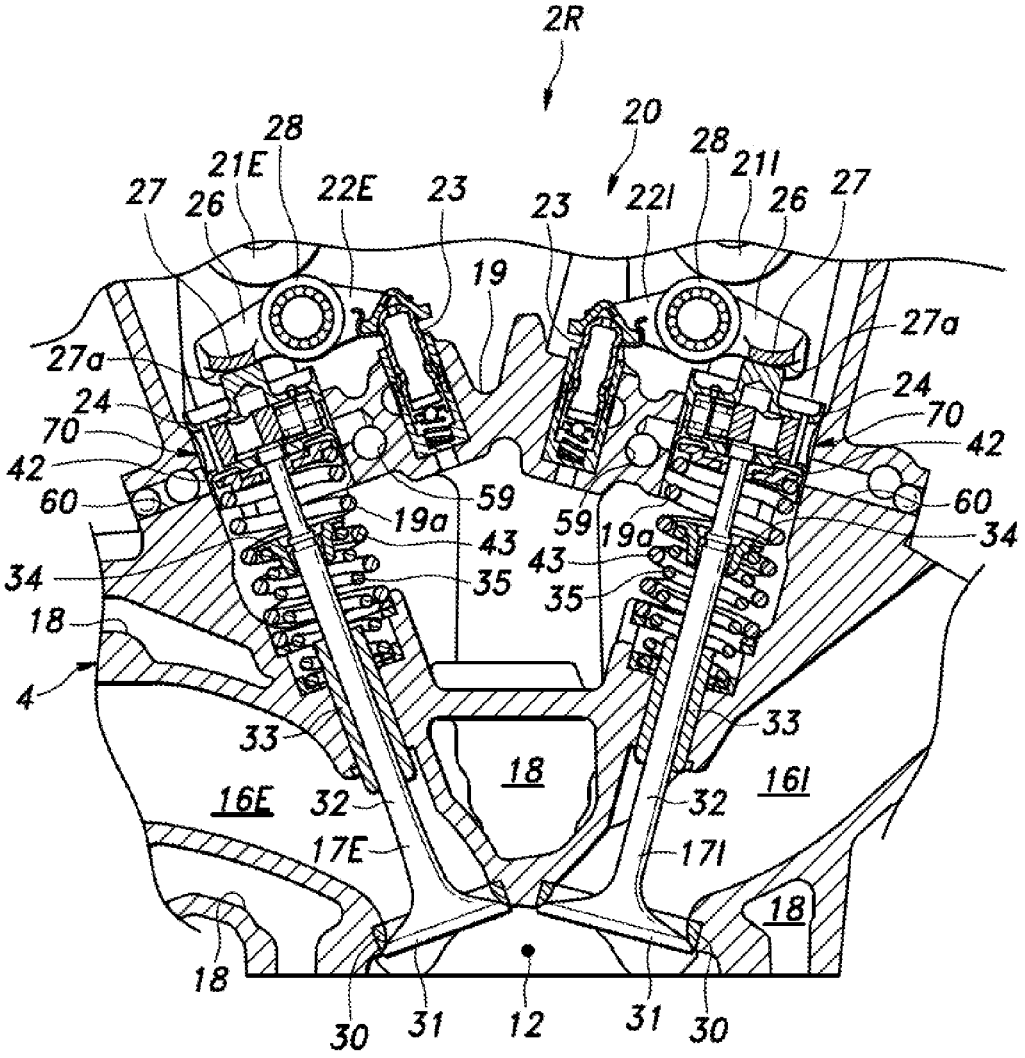
FIG. 2 is a sectional view of a cylinder head of a rear cylinder bank shown in FIG. 1.
Figure 3:
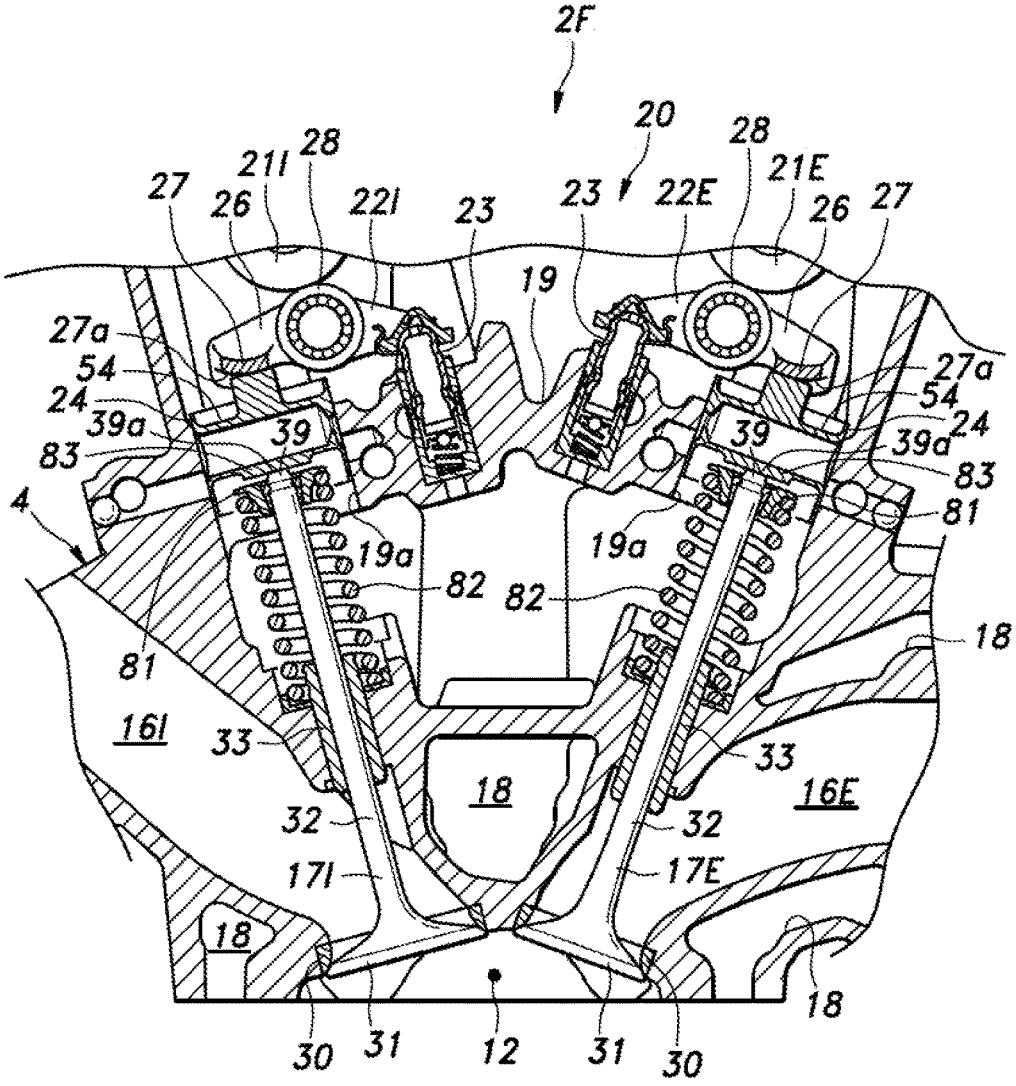
FIG. 3 is a sectional view of a cylinder head of a front cylinder bank shown in FIG. 1.

FIG. 2 is a sectional view of the cylinder head 4 of the rear cylinder bank 2R shown in FIG. 1, and FIG. 3 is a sectional view of the cylinder head 4 of the front cylinder bank 2F shown in FIG. 1. The valve actuating device 20 for the rear cylinder bank 2R is provided with a valve rest mechanism 70 which will be described hereinafter. The valve actuating device 20 for the front cylinder bank 2F is not provided with a valve rest mechanism 70, but is otherwise similar to that for the rear cylinder bank 2R. The valve actuating device 20 for the rear cylinder bank 2R is described in the following, and the valve actuating device 20 for the front cylinder bank 2F is thereafter described only with regard to the parts that are different from that for the rear cylinder bank 2R.

As shown in FIG. 2, the cylinder head 4 internally defines a water jacket 18 that passes cooling water in parts that are above the combustion chambers 12, above and below the exhaust ports 16E and below the intake ports 161. The cylinder head 4 includes a support wall 19 extending along the upper extent of the water jacket 18, and the support wall 19 supports the lash adjusters 23 and the valve lifters 24.

The support wall 19 is formed with support holes 19*a* for slidably supporting the valve lifters 24 along the axial direction of the corresponding valves 17. The lash adjuster 23 for each valve 17 is provided on the cylinder axial line side of the corresponding support hole 19*a*. The rocker arms 22 are of the swing arm configuration, and are each provided with a base end pivotally supported by the lash adjuster 23 and a free end or a swing end configured to abut the valve lifter 24. Each rocker arm 22 includes a pair of vertical walls 26 extending from the base end of the rocker arm 22 away from the cylinder axial line in a mutually parallel relationship, a sliding member 27 extending between the free end parts of the two vertical walls 26 and configured to engage the valve lifter 24, and a cam follower 28 provided in an intermediate part of the vertical walls 26 and rotatably supporting a roller that is engaged by the corresponding cam 21*a*. The sliding member 27 of the rocker arm 22 is provided with a lower surface 27*a* consisting of a surface which is arcuate and convex in side view but planar in front view.

Each valve 17 includes a valve head 31 for selectively closing the intake port or the exhaust port opening into the combustion chamber 12 by being seated on a valve seat 30 provided on the upper wall surface of the combustion chamber 12, and a valve stem 32 extending upward from the valve head 31. The valve 17 is slidably supported by the cylinder head 4 via a cylindrical valve guide 33 fitted into the cylinder head 4 and slidably guiding the valve stem 32. The valve lifter 24 is interposed between the valve 17 and the rocker arm 22, and is slidably guided by the support hole 19*a*. A valve rest mechanism 70 is incorporated in the valve lifter 24.

The valve rest mechanism 70 is hydraulically actuated, and can selectively take a valve active condition where the valve 17 is actuated in synchronism with the rotation of the camshaft 21 and a valve rest condition where the valve 17 is kept closed without regard to the rotational angle of the camshaft 21. The valve rest mechanism 70 is provided in each of the four valve lifters 24 of each cylinder, and all of the valve rest mechanisms 70 are simultaneously switched between the valve active condition and the valve rest condition so that the engine may be switched between a cylinder active state where all of the cylinders produce drive force and a cylinder rest state where some of the cylinders are kept inactive. These valve rest mechanisms 70 are provided for each cylinder on the rear cylinder bank 2R, and jointly form a cylinder rest mechanism 71 for preventing the operation of the valves 17 and thereby preventing the combustion cycles of the corresponding cylinders under a prescribed operating condition of the engine.

In the illustrated embodiment, by selectively operating the cylinder rest mechanism 71, the engine can be operated under a partial cylinder operation where all of the cylinders of the rear cylinder bank 2R are not operated while all of the cylinder of the front cylinder bank 2F are operated, and a full cylinder operation where all of the cylinders of the rear and front cylinder banks 2 are operated. The full cylinder operation is selected when the engine load is high such as when the vehicle is starting off and accelerating, and the partial cylinder operation is selected when the engine load is light such as when the vehicle is traveling at a constant speed or idling. This selection is performed by an ECU (engine control unit) not shown in the drawings according to various variables such as the depression of the accelerator pedal and the engine rotational speed.

Figure 4:
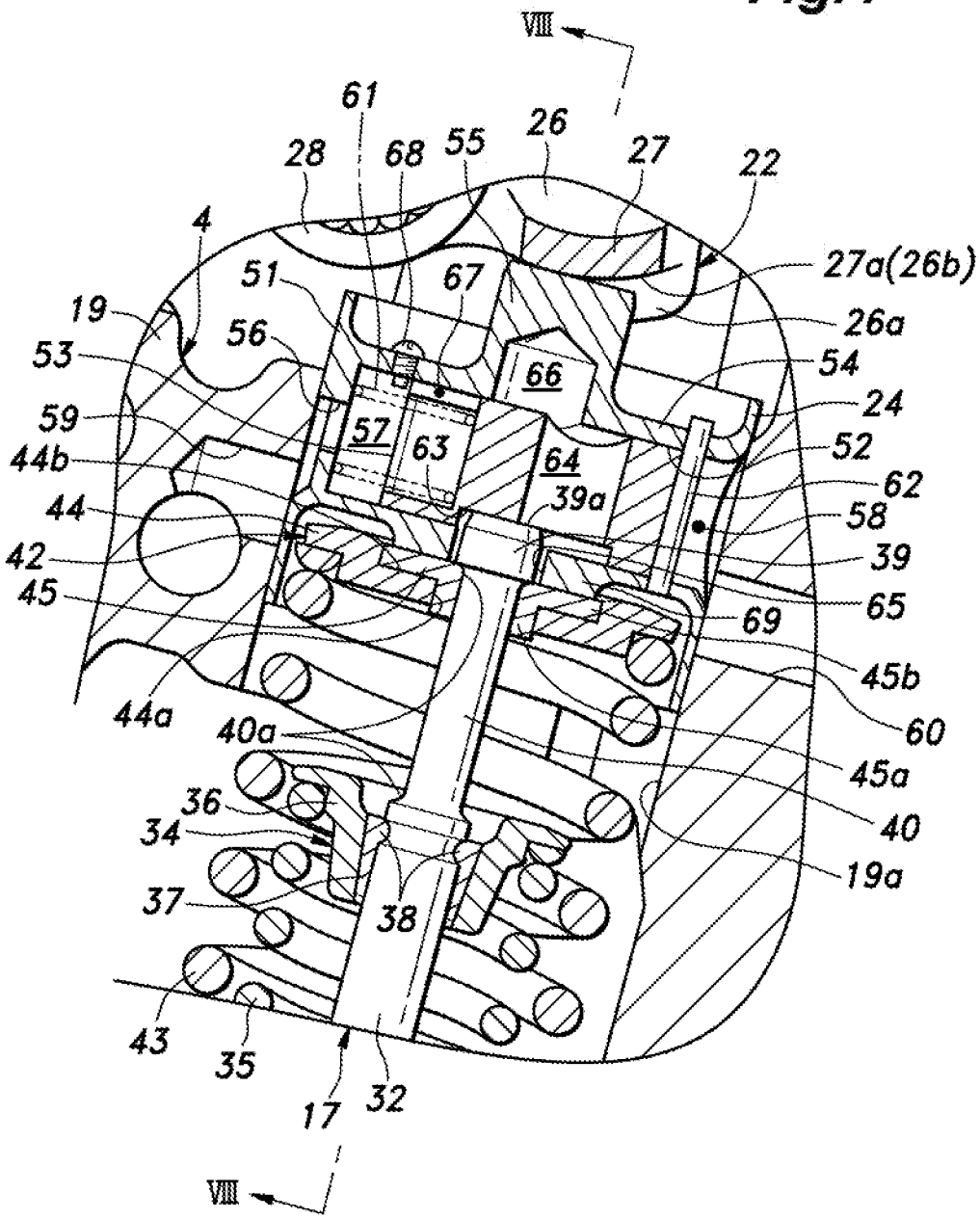
FIG. 4 is an enlarged sectional view showing a part of FIG. 2.

FIG. 4 is an enlarged sectional view showing a part of FIG. 2 (the part surrounding the valve lifter 24 of the intake side). In FIG. 4, the valve rest mechanism 70 is in the valve active condition, and the valve 17 is closed. As the valve actuating devices 20 are substantially symmetric between the intake side and the exhaust side, no distinction may be made between the intake side and the exhaust side, and suffices I and E may be omitted from the numerals denoting various parts of the valve actuating devices 20 in the following description.

As shown in FIGS. 2 and 4, a first spring retainer 36 is fixedly secured to an intermediate part of the valve stem 32 via a first valve cotter 37. The first spring retainer 36 engages an end of a first valve spring 35 having a relatively small diameter and surrounding the valve stem 32, and the other end of the first valve spring 35 is engaged by the upper surface of the support wall 19 of the cylinder head 4. The first valve spring 35 urges the valve 17 in the closing direction.

The first spring retainer 36 essentially consists of a tapered tube and is provided with a radial flange in an upper large diameter end thereof, and the first valve cotter 37 is interposed between the first spring retainer 36 and the valve stem 32. The inner circumferential surface of the first spring retainer 36 is tapered toward the lower end of the first spring retainer 36, and the first valve cotter 37 consists of two halves jointly defining an outer circumferential surface complementary to the inner circumferential surface of the first spring retainer 36. The inner circumferential surface of the first valve cotter 37 defines a cylindrical bore which snugly receives the valve stem 32, and is formed with an annular projection 38 which fits into a complementary annular groove formed in the valve stem 32 so that the first spring retainer 36 is fixedly attached to the valve stem 32 via the first valve cotter 37, and the spring force of the first valve spring 35 keeps the first valve cotter 37 firmly wedged between the first spring retainer 36 and the valve stem 32.

The valve stem 32 is provided with a small diameter section 40 extending between the part carrying the first spring retainer 36 and a stem end 39 or an upper end part of the valve stem 32. The valve stem 32 is generally cylindrical in shape, but the small diameter section 40 has a smaller diameter than the remaining part of the valve stem 32. The stem end 39 (typically having the same diameter as the remaining part of the valve stem 32) has a larger diameter than the small diameter section 40.

The small diameter section 40 is fitted into a central opening 44*a* of a second spring retainer 44 consisting of an annular disk, and a second valve cotter 45 is interposed between the second spring retainer 44 and the valve stem 32 (in particular the small diameter section 40 thereof). The second spring retainer 44 engages an end of a second valve spring 43 having a relatively large diameter and surrounding the first valve spring 35, and the other end of the second valve spring 43 is engaged by the upper surface of the support wall 19 of the cylinder head 4. The second valve spring 43 urges the valve 17 in the closing direction.

The central opening 44*a* of the second spring retainer 44 has a slightly larger diameter than the diameter of the stem end 39, and the upper end part of the second spring retainer 44 surrounding the central opening 44*a* is formed as an annular recess 44*b*. The second valve cotter 45 consists of two halves, and jointly form a tubular portion 45*a* snugly received in the central opening 44*a* of the second spring retainer 44 and an upper radial flange 45*b* snugly received in the annular recess 44*b* formed in the upper end part of the second spring retainer 44 in a complementary manner. The valve stem 32 (the small diameter section 40) is passed through the central hole 45*c* of the second valve cotter 45 in an axially slidable manner. Thus, the second spring retainer 44 is axially slidable relative to the valve stem 32, but the stem end 39 limits the upward movement of the second spring retainer 44, and thereby prevents the second spring retainer 44 from coming off from the valve stem 32. As can be appreciated from FIG. 4, the second spring retainer 44 has a smaller axial dimension than the first spring retainer 36 so that, in the illustrated embodiment, the second spring retainer 44 is entirely received in a lower tubular extension of the valve lifter 24.

The length of the small diameter section 40 is slightly longer than the sum of the axial dimension of the second spring retainer 44 and/or the second valve cotter 45, and the maximum lift of the valve 17. As the small diameter section 40 has a smaller diameter than the stem end 39 and the remaining part of the valve stem 32, an annular shoulder surface 40*a* is defined at each axial end of the small diameter section 40. The upper annular shoulder surface 40*a* is rounded when machining the small diameter section 40. The corresponding end of the second valve cotter 45 is chamfered (or rounded) in a complementary manner so that the second valve cotter 45 may abut the annular shoulder surface 40*a* on the stem end side in the manner of a surface contact. Therefore, the stem end 39 is enabled to engage the second valve cotter 45 in an accurate positional precision. Furthermore, the stress caused by the contact between the second valve cotter 45 and the annular shoulder surface 40*a* on the stem end side can be evenly distributed over a large area so that the wear of the second valve cotter 45 and the stem end 39 can be minimized.

Figure 5:
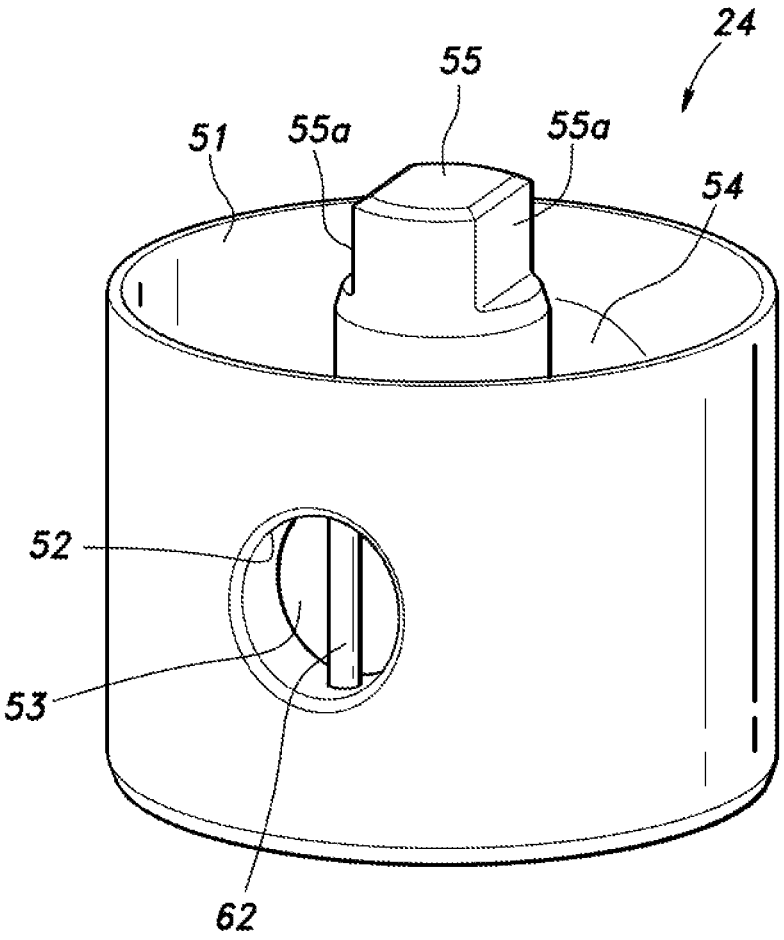
FIG. 5 is a perspective view of a valve lifter shown in FIG. 4.
Figure 6:
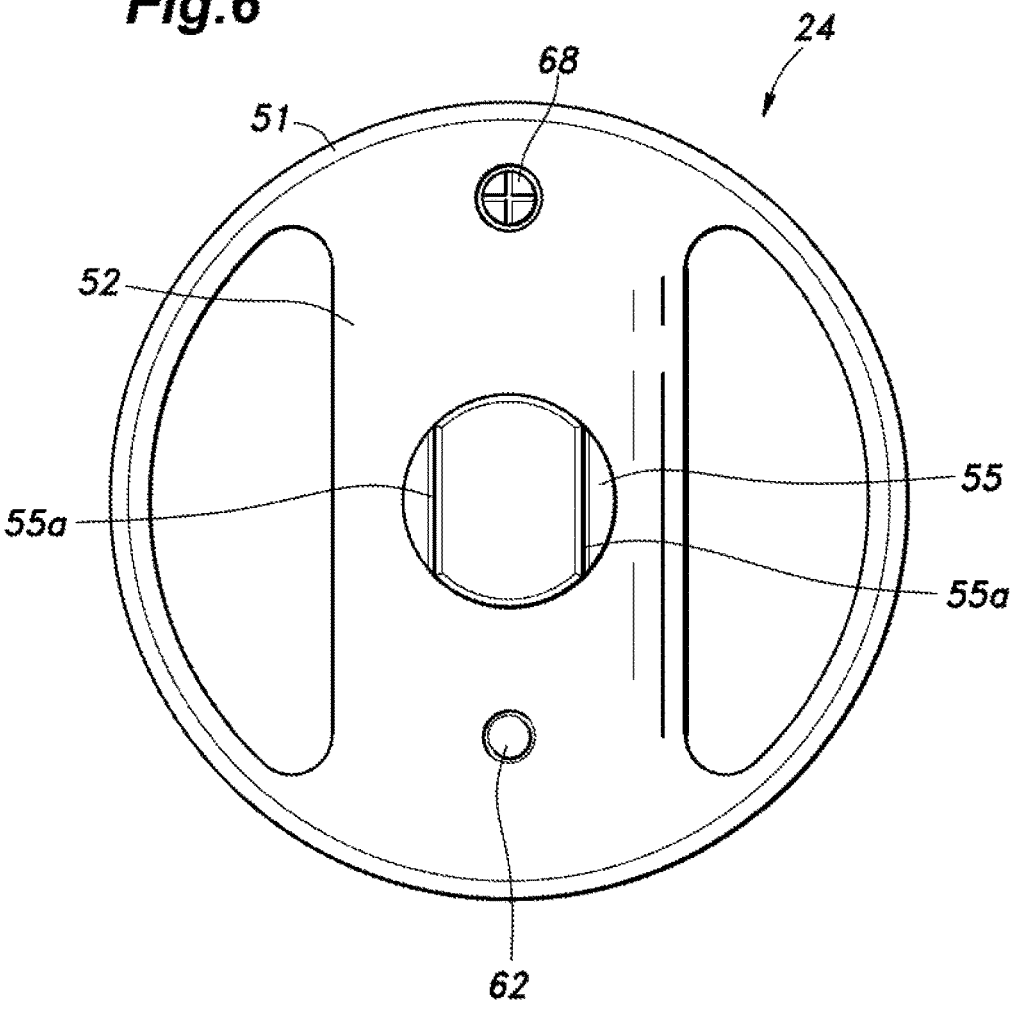
FIG. 6 is a plan view of the valve lifter shown in FIG. 4.

FIG. 5 is a perspective view of the valve lifter 24, and FIG. 6 is a plan view of the valve lifter 24. As shown in FIGS. 4 to 6, the valve lifter 24 includes a cylindrical main body 51 slidably received in the support hole 19*a*, a switch pin cylinder 54 extending between diametrically opposing parts of the cylindrical outer wall of the cylindrical main body 51 and internally defining a pin receiving hole 52 extending diametrically across the cylindrical main body 51, and a projection 55 projecting coaxially from the upper end of a central part of the switch pin cylinder 54. The peripheral part of the upper end of the main body 51 is provided with an axial flange having a top end lower than the free end of the projection 55. The peripheral part of the lower end of the main body 51 is also provided with an axial flange which extends downward beyond the lower end of the second spring retainer 44.

Thus, the main body 51 essentially consists of a tubular outer wall, and the switch pin cylinder 54 extends diametrically across the interior of the tubular outer wall. The projection 55 extends upward from a middle part of the switch pin cylinder 54. The entire assembly can be formed integrally by casting metal. This simple and sturdy structure allows the weight of the valve lifter 24 to be minimized while ensuring the necessary mechanical strength.

As shown in FIG. 4, the pin receiving hole 52 has a circular cross section, and has an axial line diagonally passing through the central axial line of the main body 51. The pin receiving hole 52 has a generally uniform cross section, and has a first end opening out on one side of the main body 51 via a narrowed opening 56 having a smaller diameter than the remaining part of the pin receiving hole 52 and a second end directly opening out on the other side of the main body 51. The valve lifter 24 is prevented from turning around the central axial line thereof in the support hole 19*a* by a means not shown in the drawings. A switch pin 53 is received in the pin receiving hole 52, and separates the pin receiving hole 52 into a first oil pressure chamber 57 on the side of the narrowed opening 56 and a second oil pressure chamber 58 on the side of the direct open end of the pin receiving hole 52. A compression coil spring 61 is placed in the first oil pressure chamber 57 to urge the switch pin 53 toward the second oil pressure chamber 58. The cylinder head 4 internally defines a first oil passage 59 communicating with the first oil pressure chamber 57 without regard to the axial position of the valve lifter 24, and a second oil passage 60 communicating with the second oil pressure chamber 58 without regard to the axial position of the valve lifter 24. A prescribed oil pressure is supplied to a selected one of the first oil passage 59 and the second oil passage 60 under the control action of an ECU.

In the state shown in FIG. 4, the rocker arm 22 is not actuated, and the valve lifter 24 is located in the uppermost position of the slidable range. A vertical groove is formed on the outer circumferential surface of the main body 51 so that the first oil passage 59 communicates with the first oil pressure chamber 57 via the narrowed opening 56 even when the valve lifter 24 is at the uppermost position. In this manner, the first oil passage 59 communicates with the first oil pressure chamber 57 via the narrowed opening 56 without regard to the axial position of the valve lifter 24. On the side of the second oil pressure chamber 58, the corresponding end of the pin receiving hole 52 directly opens out at the outer circumferential surface of the main body 51 so that the second oil passage 60 communicates with the second oil pressure chamber 58 without regard to the axial position of the valve lifter 24.

The switch pin 53 moves toward the second oil pressure chamber 58 when oil pressure is supplied to the first oil pressure chamber 57 via the first oil passage 59, and moves toward the first oil pressure chamber 57 when oil pressure is supplied to the second oil pressure chamber 58 via the second oil passage 60. The movement of the switch pin 53 toward the first oil pressure chamber 57 is limited by the abutting of the switch pin 53 with a shoulder surface of the main body 51 surrounding the narrowed opening 56, and the movement of the switch pin 53 toward the second oil pressure chamber 58 is limited by the abutting of the switch pin 53 with a stopper pin 62 passed across the pin receiving hole 52 in parallel with the axial line of the main body 51. Thus, the switch pin 53 is configured to slide between the first position at which the switch pin 53 abuts the stopper pin 62 under the biasing force of the compression coil spring 61 and the oil pressure supplied to the first oil pressure chamber 57 and a second position at which the switch pin 53 abuts the shoulder surface of the main body 51 under the oil pressure supplied to the second oil pressure chamber 58 against the biasing force of the compression coil spring 61. The combined use of the oil pressure and the compression coil spring 61 ensures an accurate positioning of the switch pin 53 at the first and second positions. Also, even when the oil pressure is lost, the compression coil spring 61 ensures the valve lifter 24 to be operational.

The lower surface of an intermediate part of the switch pin 53 is provided with a flat abutting surface 63 extending perpendicularly to the axial line of the main body 51. A part of the switch pin 53 adjoining the abutting surface 63 on the side of the second oil pressure chamber 58 is provided with a through hole 64 extending in parallel with the axial line of the main body 51 and configured to receive the stem end 39. An intermediate part of the bottom wall defining the lower surface of the pin receiving hole 52 is provided with a through hole 65 extending in parallel with the axial line of the main body 51 and configured to receive the stem end 39. When the switch pin 53 is at the second position where the switch pin 53 abuts the shoulder surface, the through hole 64 aligns with the stem end 39 and the through hole 65. The projection 55 of the valve lifter 24 is internally provided with an extension hole 66 consisting of a blind hole extending upward in parallel with the axial line of the main body 51 and configured to receive the stem end 39.

The end part of the switch pin 53 adjoining the first oil pressure chamber 57 is tubular in shape so as to define a hollow interior opening out at the free end, and is provided with an axial slot 67 at the upper end of the switch pin 53. A stopper screw 68 is threaded into the upper wall of the main body 51 in such a manner that a projection formed in the free end of the stopper screw 68 aligns with the axial slot 67 of the switch pin 53. Therefore, when the switch pin 53 is displaced from the first position toward the second position (toward the first oil pressure chamber 57), the projection of the stopper screw 68 is received in the slot 67 so that the rotation of the switch pin 53 around the axial center line thereof can be prevented.

When the switch pin 53 is at the first position or abuts the stopper pin 62 (see FIG. 4), the end surface 39*a* of the stem end 39 abuts the abutting surface 63 substantially over the entire surface area of the end surface 39*a*. As a result, the valve lifter 24 is actuated by the rocker arm 22 so that the valve 17 can be opened when so actuated. The valve 17 is normally urged against the valve lifter 24 under the spring force of the second valve spring 43, and the pressure of the end surface 39*a* of the stem end 39 applied to the abutting surface 63 of the switch pin 53 prevents the rotation of the switch pin 53 around the central axial line thereof. Also, the spring force of the second valve spring 43 is transmitted to the valve 17 because the annular shoulder surface 40*a* of the stem end 39 abuts the opposing annular region of the second valve cotter 45.

When the switch pin 53 is at the second position where the switch pin 53 abuts the annular shoulder of the main body 51, the stem end 39 slides into the through hole 64 of the switch pin 53, instead of being engaged by the abutting surface 63, so that even when the valve lifter 24 is displaced downward by the rocker arm 22, the valve 17 is not displaced in the opening direction. When the stem end 39 moves into the through hole 64, the second spring retainer 44 moves jointly with the valve lifter 24 along the small diameter section 40 of the valve stem 32. Because the axial length of the small diameter section 40 is longer than the range of movement of the second spring retainer 44, the second spring retainer 44 (or more precisely the lower end of the second valve cotter 45) does not come into contact with the annular shoulder surface 40*a* on the side of the valve head 31 even when the valve lifter 24 has traveled to the lowermost part of the maximum range of movement of the valve lifter 24.

In the illustrated embodiment, the stem end 39 has a larger diameter than the small diameter section 40 so as to define the annular shoulder surface 40*a* facing downward. Therefore, the second spring retainer 44 can retain the upper end of the second valve spring 43 via the second valve cotter 45 in a stable manner. This simplifies the assembly work for the valve lifter 24. The extension hole 66 formed in the projection 55 of the valve lifter 24 provides an additional stroke of the valve stem 32 relative to the valve lifter 24.

The part of the lower wall (bottom wall) of the main body 51 surrounding the through hole 65 is formed with an annular projection 69 projecting downward. The lower surface of the annular projection 69 provides a contact surface for the second valve cotter 45. The annular projection 69 increases the length of the through hole 65 without unduly increase the thickness of the lower wall or the weight of the main body 51. In particular, the axial length of the stem end 39 is substantially equal to the sum of the axial length of the through hole 65 and the depth of the abutting surface 63 from the otherwise cylindrical lower surface of the switch pin 53.

The outer diameter of the annular projection 69 is slightly smaller than the outer diameter of the second valve cotter 45 (the radial flange 45*b* thereof) so that the annular projection 69 abuts the second valve cotter 45 but not the second spring retainer 44. In the valve rest condition or when the switch pin 53 is at the second position, the second spring retainer 44 along with the second valve cotter 45 slides along the small diameter section 40 of the valve stem 32, but owing to the spring force of the second valve spring 43, the upper surface of the second valve cotter 45 is always pressed against the flat surface of the annular projection 69. In the valve active condition, the second spring retainer 44 along with the second valve cotter 45 moves jointly with the stem end 39, but is always pressed against the annular projection 69 by the spring force of the second valve spring 43. As a result, the stress produced in the second spring retainer 44 can be minimized so that the necessary thickness of the second spring retainer 44 can be minimized.

Also, because the annular projection 69 abuts only the second valve cotter 45, and is kept in contact with the second valve cotter 45 at all times, the second valve cotter 45 is always interposed between the second spring retainer 44 and the annular projection 69 of the valve lifter 24 under the spring force of the second valve spring 43. Therefore, even though the second valve cotter 45 is not provided with a tapered surface, there is no risk of the second valve cotter 45 being dislodged. For this reason, the combined axial dimension of the second spring retainer 44 and the second valve cotter 45 can be minimized.

The axial dimensions of the annular projection 69 and the stem end 39 are determined such that when the second valve cotter 45 is in contact with the annular projection 69, the switch pin 53 is enabled to slide in the pin receiving hole 52, although there is substantially no gap between the abutting surface 63 of the switch pin 53 and the end surface 39*a* of the stem end 39.

As shown in FIGS. 4 and 5, the projection 55 of the valve lifter 24 is provided with a circular cross section in a base end part thereof adjoining the switch pin cylinder 54, and a track-shaped cross section in a free end (upper end) part thereof. Therefore, a pair of planar side surfaces 55*a* are defined on either side thereof so as to extend in parallel with the vertical walls 26. The free end (upper end) of the projection 55 defines a planar surface perpendicular to the axial line of the main body 51.

Figure 7:
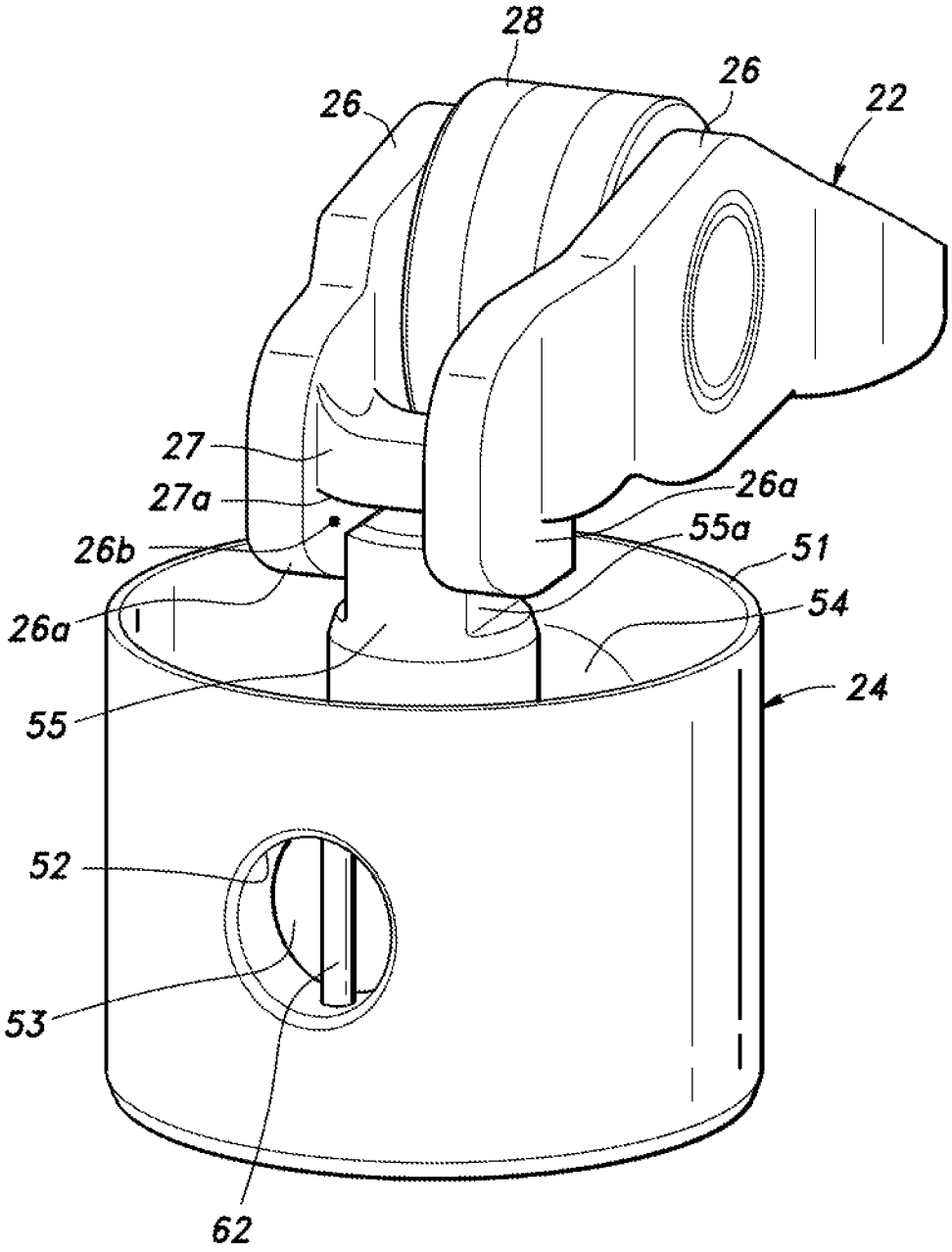
FIG. 7 is a perspective view of the valve lifter and an associated rocker arm.
Figure 8:
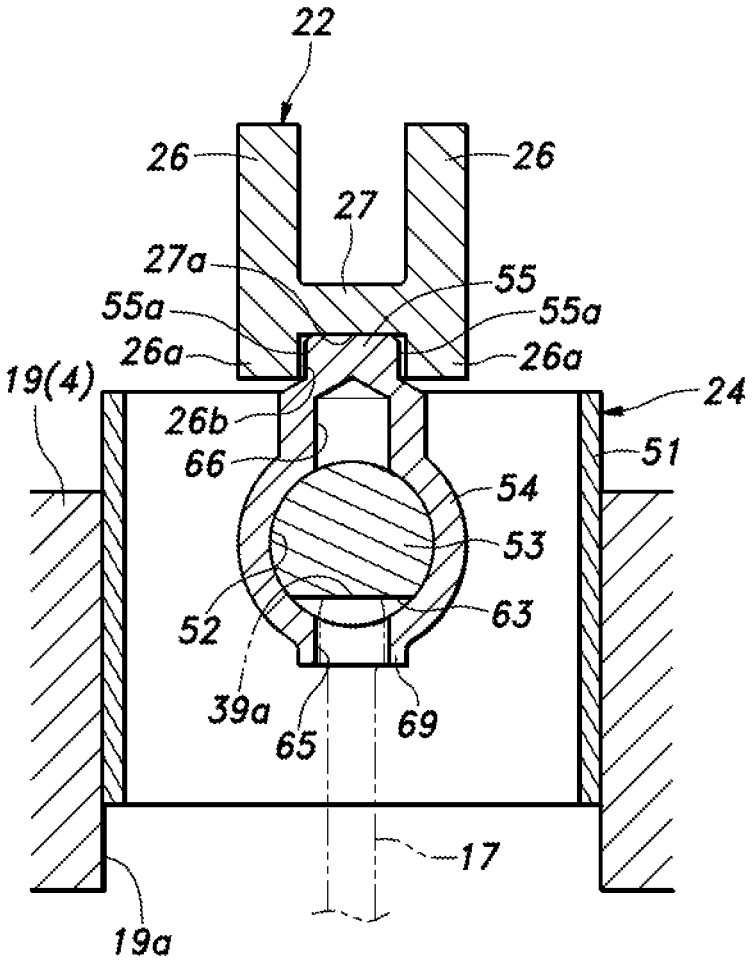
FIG. 8 is a sectional view taken along line VIII-VIII of FIG. 4.

FIG. 7 is a perspective view showing the valve lifter 24 and the rocker arm 22, and FIG. 8 is a sectional view taken along line VIII-VIII of FIG. 4. The vertical walls 26 are formed with lower extensions 26*a* extending downward beyond the lower surface 27*a* of the sliding member 27 so that a slot 26*b* is defined between the lower extensions 26*a* of the vertical walls 26, and the upper end of the slot 26*b* is delimited by the lower surface 27*a* of the sliding member 27. The width of this slot 26*b* is slightly greater than the lateral width of the upper end of the projection 55 (or the distance between the two side surfaces 55*a* of the projection 55). Therefore, the valve lifter 24 is prevented from rotating around the axial line thereof owing to the engagement between the mutually opposing inner surfaces of the lower extensions 26*a* and the side surfaces 55*a* of the upper end of the projection 55 while the stem end of the valve 17 is kept engaged by the lower surface 27*a* (sliding surface) of the sliding member 27 under the biasing force of the first and second valve springs 35 and 43. As a result, the first oil passage 59 communicates with the first oil pressure chamber 57, and the second oil passage 60 communicates with the second oil pressure chamber 58 at all times.

The valve rest mechanism 70 is provided for each of the valves 17 of each cylinder in one of the cylinder banks, and the cylinder rest mechanism 71 is formed by all of these valve rest mechanisms 70.

The process of assembling the valve actuating device 20 incorporated with the valve rest mechanisms 70 to the cylinder head 4 is described in the following. As shown in FIGS. 2 and 4, the valve stem 32 is inserted into the valve guide 33 from the side of the combustion chamber 12. The first valve spring 35 having a relatively small diameter is fitted on the valve stem 32 that projects upward from the valve guide 33, and while the first valve spring 35 is compressed by using a suitable jig, the first spring retainer 36 is attached to the intermediate part of the valve stem 32 (or immediately below the lower end of the small diameter section 40). This is accomplished by engaging the two halves of the first valve cotter 37 with the annular projection 38, and releasing the compression of the first valve spring 35 so as to cause the first spring retainer 36 to be retained by the first valve cotter 37 under the spring force of the first valve spring 35. Thus, the valve 17 is normally biased toward the closed position under the spring force of the first valve spring 35 via the first spring retainer 36.

The second valve spring 43 having a relatively large diameter is fitted on the first valve spring 35, and while the second valve spring 43 is compressed, the second spring retainer 44 is attached to the upper end of the small diameter section 40 of the valve stem 32. This is accomplished by fitting the central opening 44*a* of the second spring retainer 44 onto the small diameter section 40, placing the two halves of the second valve cotter 45 around the small diameter section 40 in a slidable manner, and releasing the compression of the second valve spring 43 so as to cause the second spring retainer 44 to be fitted on the small diameter section 40 via the second valve cotter 45 under the spring force of the second valve spring 43. As a result, the second valve cotter 45 is kept engaged to the stem end 39 so that the valve 17 is normally urged toward the closed position additionally under the spring force of the second valve spring 43 via the second spring retainer 44.

Thereafter, the valve lifter 24 is inserted into the support hole 19*a* of the cylinder head 4, and placed on top of the second valve cotter 45 via the annular projection 69. Because the first valve spring 35 and the second valve spring 43 are held in a pre-compressed state, this can be accomplished simply by placing the valve lifter 24 on top of the second valve cotter 45. Then, the rocker arm 22 is positioned on the support wall 19 so as to abut both the lash adjuster 23 arranged on the support wall 19 and the projection 55 of the valve lifter 24, and the camshaft 21 is assembled on top of the rocker arm 22. This completes the assembling of the valve actuating device 20.

The mode of operation of the valve rest mechanism 70 is described in the following with reference to FIGS. 9*a*, 9*b*, 10*a* and 10*b*. FIG. 9*a* shows the valve rest mechanism 70 in the valve active condition when the rocker arm 22 is not pressed down by the cam 21*a*, and FIG. 7*b* shows the valve rest mechanism 70 in the valve active condition when the rocker arm 22 is pressed down by the cam 21*a*. FIG. 10*a* shows the valve rest mechanism 70 in the valve rest condition when the rocker arm 22 is not pressed down by the cam 21*a*, and FIG. 10*b* shows the valve rest mechanism 70 in the valve rest condition when the rocker arm 22 is pressed down by the cam 21*a*. The valve 17 shown in FIG. 4 was an intake valve, but the valve 17 shown in FIGS. 9*a* to 10*b* is an exhaust valve.

Figure 9B:
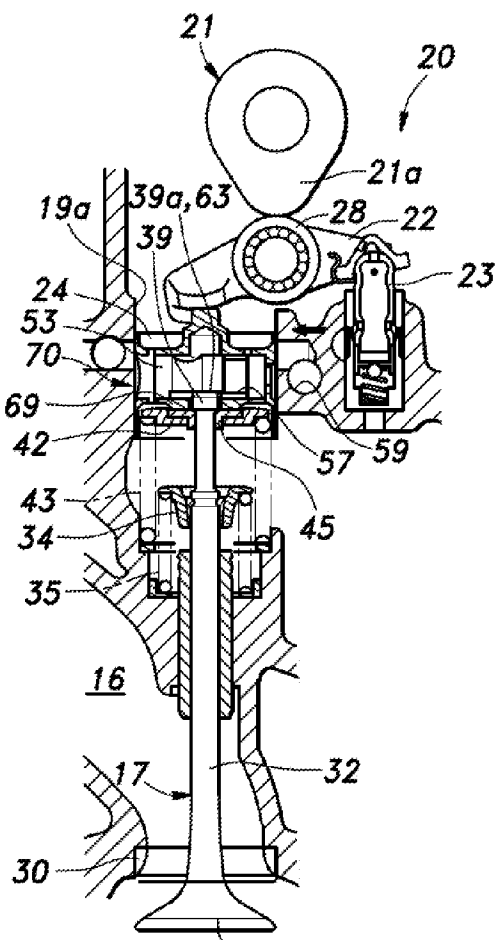
FIGS. 9*a* and 9*b* are sectional views showing a valve active condition of the valve actuating device provided with a valve rest mechanism.
Figure 9A:
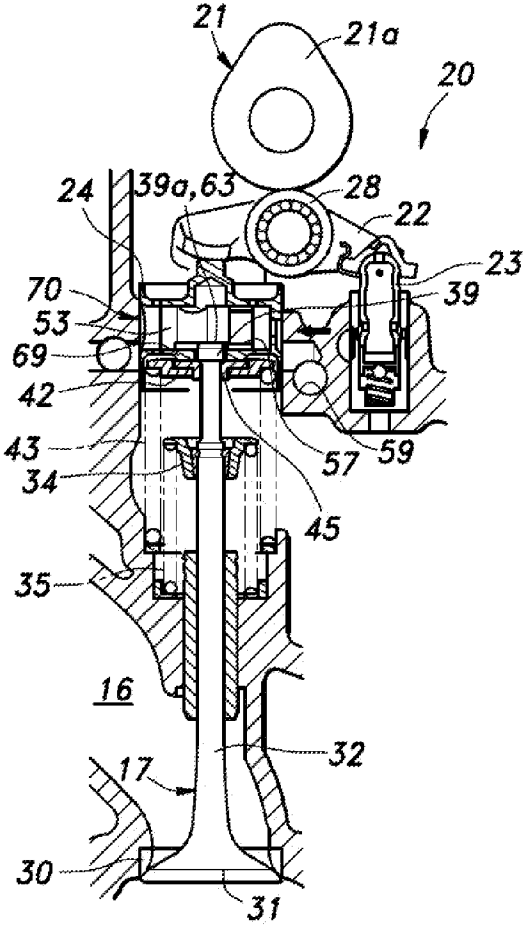
Figure 10B:
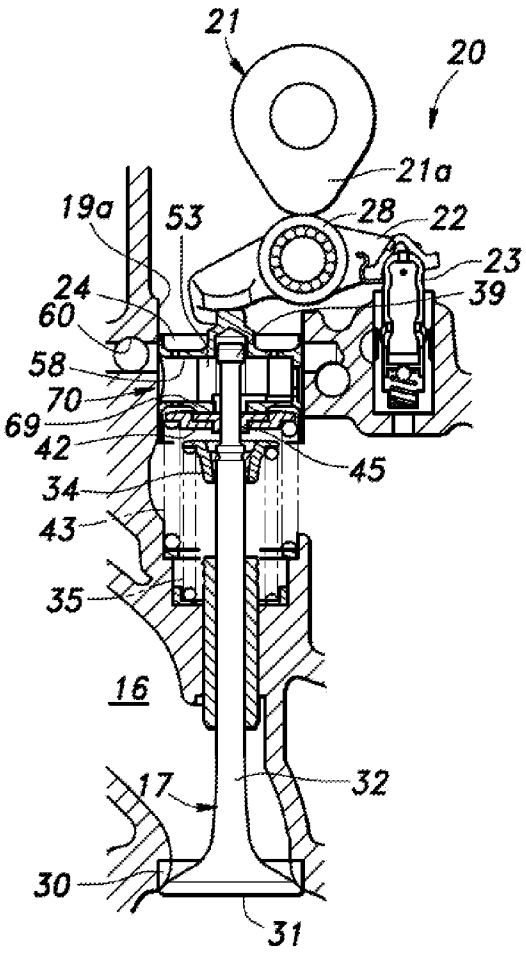
FIGS. 10*a* and 10*b* are sectional views showing a valve rest condition of the valve actuating device.
Figure 10A:
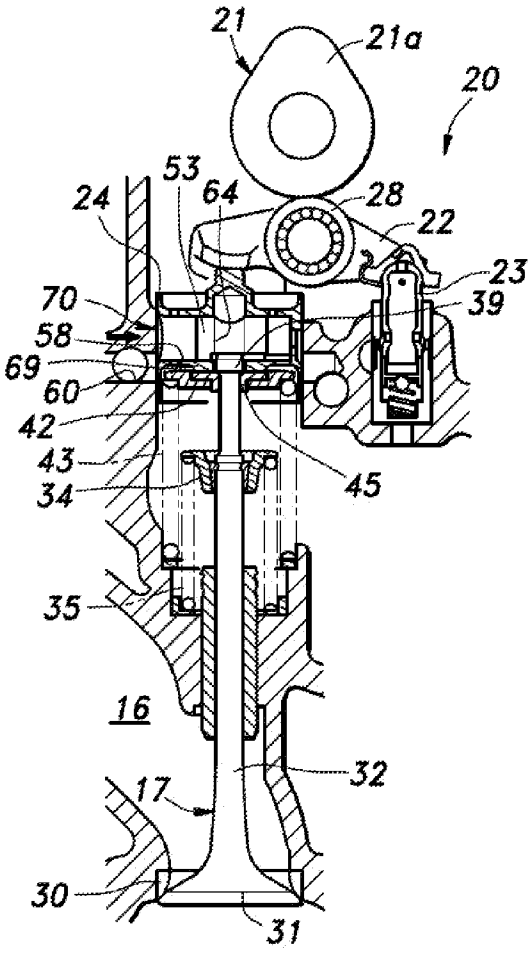

In the valve active condition, as shown in FIGS. 9*a* and 9*b*, the switch pin 53 is displaced rightward owing to the oil pressure supplied to the first oil pressure chamber 57 via the first oil passage 59, and the end surface 39*a* of the stem end 39 abuts the abutting surface 63 of the switch pin 53. When the cam follower 28 is engaged by the base circle of the cam 21*a*, and the rocker arm 22 is therefore not depressed as shown in FIG. 9*a*, the valve 17 is urged upward by the first valve spring 35 via the first spring retainer 36 and by the second valve spring 43 via the second spring retainer 44 so that the valve head 31 is seated on the valve seat 30, and the valve 17 is closed. At this time, the upper surface of the second valve cotter 45 abuts the annular projection 69, and/or the end surface 39*a* of the stem end 39 abuts the abutting surface 63 of the switch pin 53 under the spring force of the second valve spring 43.

When the rocker arm 22 is depressed downward by the cam 21*a* as shown in FIG. 9*b*, the valve lifter 24 is displaced downward in the support hole 19*a*, and the abutting surface 63 pushes the end surface 39*a* downward, causing the valve 17 to be displaced downward by a same stroke as the valve lifter 24. As a result, the valve head 31 is lifted from the valve seat 30, and the valve 17 is opened. During the downward stroke of the valve lifter 24, the annular projection 69 pushes the upper surface of the second valve cotter 45, and compresses the second valve spring 43. During the upward stroke of the valve lifter 24, the annular projection 69 and the upper surface of the second valve cotter 45 are pressed against each other under the spring force of the second valve spring 43. Thus, the combined spring force of the first valve spring 35 and the second valve spring 43 urges the valve 17 in the closing direction at all times in the valve active condition.

In the valve rest condition, as shown in FIGS. 10*a* and 10*b*, the switch pin 53 is displaced leftward owing to the oil pressure supplied to the second oil pressure chamber 58 via the second oil passage 60, and the valve stem 32 aligns with the through hole 64 of the switch pin 53. When the cam follower 28 is engaged by the base circle of the cam 21*a*, and the rocker arm 22 is therefore not depressed as shown in FIG. 10*a*, the valve 17 is urged upward by the first valve spring 35 via the first spring retainer 36 and by the second valve spring 43 via the second spring retainer 44 so that the valve head 31 is seated on the valve seat 30, and the valve is closed, similarly as in FIG. 9*a*. At this time, the upper surface of the second valve cotter 45 abuts the annular projection 69, and/or the end surface 39*a* of the stem end 39 abuts the abutting surface 63 of the switch pin 53 under the spring force of the second valve spring 43.

When the rocker arm 22 is depressed downward by the cam 21*a* as shown in FIG. 10*b*, the valve lifter 24 is displaced downward in the support hole 19*a*, and the stem end 39 advances upward in the through hole 64 and into the extension hole 66. As a result, the valve 17 is not actuated by the valve lifter 24, and remains closed. During the upward stroke of the valve lifter 24, the annular projection 69 and the upper surface of the second valve cotter 45 are pressed against each other under the spring force of the second valve spring 43.

Referring to FIG. 3 once again, the difference of the valve actuating device 20 of the front cylinder bank 2F from that of the rear cylinder bank 2R is described in the following. In this case also, as the intake side and the exhaust side are symmetric to each other, the various components are simply denoted with numerals without the suffixes for indicating if the particular component part belongs to the intake side or the exhaust side of the engine.

As shown in FIG. 3, in the valve actuating device 20 for the front cylinder bank 2F, the valve lifter 24 interposed between the valve 17 and the rocker arm 22 is not internally incorporated with a valve rest mechanism 70. However, the main body 51 of the valve lifter 24 for the front cylinder bank 2F may be made from a common die cast or forged member as that for the rear cylinder bank 2R, and the two kinds of the main bodies 51 may be prepared by machining the common die cast or forged member differently. The valve 17 consists of a regular poppet valve including a valve head 31 and a valve stem 32. The valve stem 32 has a uniform cross section substantially over the entire length thereof. A third spring retainer 81 is attached to a part of the stem end 39 of the valve stem 32 via a third valve cotter 80, and supports an end of a third valve spring 82 having a substantially same outer diameter as the first valve spring 35 and a slightly greater wire diameter than the first valve spring 35. The other end of the third valve spring 82 is supported by a spring seat provided in the support wall of the cylinder head 4. The third valve spring 82 consists of a compression coil spring, and normally urges the valve 17 in the closing direction. The third spring retainer 81 and the third valve cotter 80 are similar to the first spring retainer 36 and the first valve cotter 37, respectively.

The valve lifter 24 is not incorporated with the valve rest mechanism 70, but is otherwise similar to those used in the rear cylinder bank 2R. In the illustrated embodiment, the valve lifter 24 is provided with a pin receiving hole, but is not provided with a switch pin 53. The lower wall of the main body of the valve lifter 24 is provided with a circular projection 83, but is not provided with a through hole 65. Therefore, the end surface 39*a* of the stem end 39 of the valve 17 always centrally abuts the circular projection 83 of the valve lifter 24 so that the valve 17 is actuated in the opening direction as the valve lifter 24 is driven downward by the cam 21*a* via the rocker arm 22.

The valve actuating device 20 incorporated with the valve rest mechanism 70 offers the following advantages.

As shown in FIG. 4, the valve actuating device 20 includes a valve lifter 24 interposed between the swing end of the rocker arm 22 and the stem end of the valve 17, and the switch pin 53 received in the switch pin cylinder 54 of the valve lifter 24 is moveable under oil pressure between the first position where the abutting surface 63 of the switch pin 53 engages the stem end of the valve 17, and the second position where the through hole 64 of the switch pin 53 aligns with the stem end of the valve 17. The swing end of the rocker arm 22 is formed with a slot 26*b* extending in the lengthwise direction of the rocker arm 22, and the projection 55 projecting from the upper end of the valve lifter 24 defines the side surfaces 55*a* so that the valve lifter 24 is prevented from rotating around the central axial line thereof. Therefore, the valve lifter 24 can be prevented from rotating without requiring any additional component parts or without performing any special machining work on the cylinder head 4. Furthermore, annular grooves are not required to be formed on the outer circumferential surface or the inner circumferential surface of the support hole 19*a* supporting the valve lifter 24 for supply the oil pressure required for actuating the switch pin 53. This simplifies the assembly process.

Modified Embodiment

Figure 11:
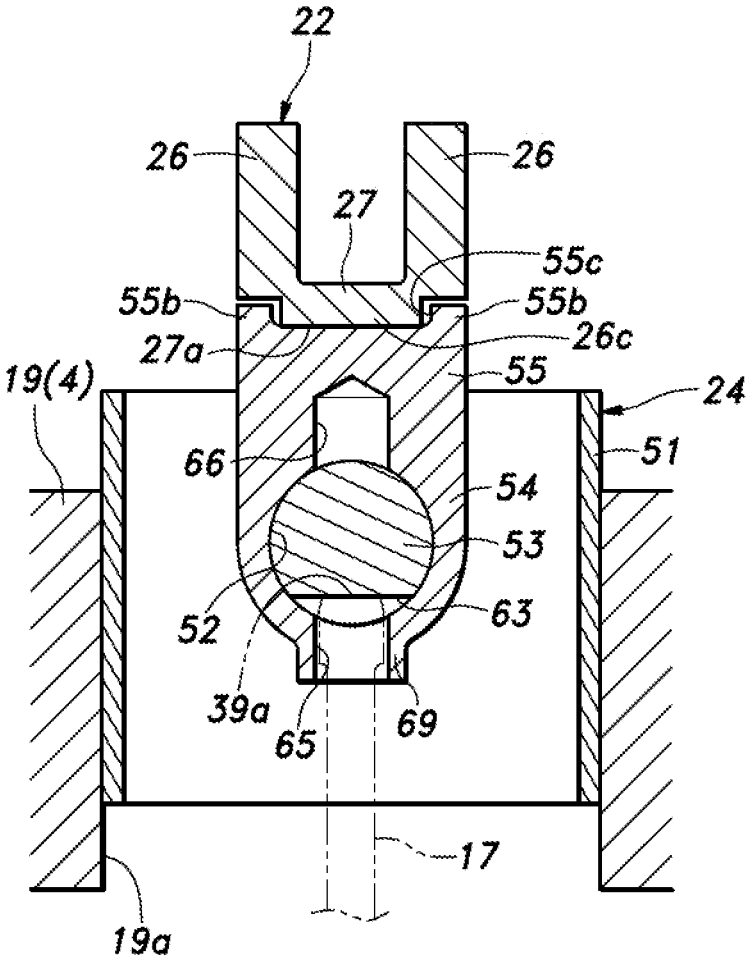
FIG. 11 is a view similar to FIG. 8 showing a modified embodiment of the present invention.

FIG. 11 is a view similar to FIG. 8 showing a modified embodiment of a valve actuating device 20 incorporated with a valve rest mechanism 70. Only the part of the valve rest mechanism different from those of the preceding embodiment are described in the following. The two vertical walls 26 of the swing end of the rocker arm 22 are connected to each other via a sliding member 27 having a lower surface 27*a* projecting downward beyond the lower ends of the two vertical walls 26. In other words, the lower end of the swing end of the rocker arm 22 is provided with a projection 26*c* elongated in the lengthwise direction of the rocker arm 22. The sliding member 27 is provided with a lower surface 27*a* which is arcuate and convex surface in side view but is planar in front view, and a pair of planar side surfaces extending vertically in a mutually parallel relationship.

The upper end of the projection 55 of the valve lifter 24 is provided with a receiving recess 55*c* flanked by a pair of low vertical walls 55*b*. The receiving recess 55*c* (as well as the vertical walls 55*b*) is elongated in the lengthwise direction of the rocker arm 22, and has a substantially planar bottom surface and a pair of planar side surfaces. The width of the receiving recess 55*c* (or the distance between the opposing surfaces of the vertical walls 55*b*) is slightly greater than the width of the projection 26*c* (distance between the side surfaces thereof). Therefore, the projection 55 and the main body 51 of the valve lifter 24 is prevented from rotating relative to the swing end of the rocker arm 22.

In this embodiment also, the valve lifter 24 is prevented from rotating in the support hole 19*a* so that the first oil passage 59 communicates with the first oil pressure chamber, and the second oil passage 60 communicates with the second oil pressure chamber 58 at all times.

Although the present invention has been described in terms of preferred embodiments thereof, it is obvious to a person skilled in the art that various alterations and modifications are possible without departing from the scope of the present invention. For instance, the foregoing embodiments were directed to a variable valve actuating device configured to selectively perform a full cylinder operation and the partial cylinder operation, but the present invention may also be applied to a variable valve actuating device configured to selectively perform a variable valve lift operation whereby the lift of the valve may be selectively varied over a range selected from 0% to 100%. The type of the engine to which the invention may be applied is not limited to a DOHC engine, but also any other types of engines such as SOHC and OHV engines. The valve actuating device may use a see-saw type rocker arm, instead of the swing arm type rocker arm.

The invention claimed is:

1. A variable valve actuating device for an internal combustion engine, comprising:

a valve having a valve head configured to selectively close an intake port or an exhaust port of a combustion chamber and a valve stem slidably supported by a cylinder head along an axial line thereof;

a rocker arm including a pivoted part pivotally supported by the cylinder head, a cam follower driven by a cam of a camshaft, and a swing end;

a valve lifter interposed between the swing end of the rocker arm and a stem end of the valve stem and slidably received in a support hole defined in the cylinder head along the axial line of the valve stem; and a switch member received in the valve lifter so as to be selectively moveable under oil pressure between a first position where the switch member abuts an end surface of the valve stem as the valve lifter is actuated by the cam and a second position where the switch member does not abut the end surface of the valve stem as the valve lifter is actuated by the cam;

wherein the swing end of the rocker arm is engaged by an upper end part of the valve lifter via an engagement feature that prevents a rotational movement of the valve lifter relative to the swing end around the axial line of the valve stem.

2. The variable valve actuating device according to claim 1, wherein the swing end of the rocker arm includes a pair of vertical walls defining a gap between the vertical walls, and the upper end part of the valve lifter is provided with a projection projecting upward and defining a pair of side surfaces closely abutting opposing surfaces of the vertical walls.

3. The variable valve actuating device according to claim 2, wherein the projection is elongated in a direction parallel to a central line of the rocker arm.

4. The variable valve actuating device according to claim 2, wherein the valve lifter includes a cylindrical outer wall extending along the axial line of the valve stem and a switch pin cylinder extending between diametrically opposing parts of the cylindrical outer wall, and the switch member comprises a switch pin slidably received in the switch pin cylinder so as to be moveable between the first position and the second position under oil pressure applied to either axial end of the switch pin, the switch pin including an abutting surface configured to abut the end surface of the valve stem at the first position and a through hole for receiving the stem end of the valve stem at the second position, the projection being integrally formed with the switch pin cylinder.

5. The variable valve actuating device according to claim 2, wherein the two vertical walls of the swing end of the rocker arm are connected to each other via a sliding member, a lower surface of the sliding member defining a surface for sliding contact with the projection of the valve lifter.

6. The variable valve actuating device according to claim 1, wherein the swing end of the rocker arm includes a projection projecting downward and defining a pair of side surfaces, and the upper end part of the valve lifter is provided with a recess flanked by a pair of vertical walls defining a pair of side surfaces closely abutting the opposing side surfaces of the projection of the swing end of the rocker arm.

7. The variable valve actuating device according to claim 6, wherein the recess is elongated in a direction parallel to a central line of the rocker arm.

* * * * *